United States Patent [19]

Hinterkeuser et al.

[11] 3,998,583

[45] Dec. 21, 1976

[54] APPARATUS FOR THERMAL TREATMENT OF MOIST RAW MATERIAL

[75] Inventors: Jakob Hinterkeuser, St. Augustin; Andris Abelitis, Hoffnungsthal, both of Germany

[73] Assignee: Klockner, Humboldt-Deutz Aktiengesellschaft, Germany

[22] Filed: Aug. 20, 1975

[21] Appl. No.: 606,194

[30] Foreign Application Priority Data

Aug. 21, 1974 Germany ..... 2440053

[52] U.S. Cl. ..... 432/14; 34/57 R; 432/58; 432/106

[51] Int. Cl.[2] ..... F27B 15/00; F26B 17/00

[58] Field of Search ..... 432/14, 15, 58, 106; 34/57 R

[56] References Cited

UNITED STATES PATENTS

| | | | |
|---|---|---|---|
| 3,738,794 | 6/1973 | Thelen | 432/106 |
| 3,884,620 | 5/1975 | Rammler | 432/15 |

FOREIGN PATENTS OR APPLICATIONS

| | | |
|---|---|---|
| 394,953 | 12/1965 | Switzerland |

*Primary Examiner*—John J. Camby
*Attorney, Agent, or Firm*—Hill, Gross, Simpson, Van Santen, Steadman, Chiara & Simpson

[57] ABSTRACT

Method and apparatus for the thermal treatment of moist raw pulverulent material, particularly slurries of raw cement material, wherein a plurality of gas and material separators are connected in series, the material to be treated is introduced between the last separator and the next-to-the-last separator and penetration of infiltrated air into the gas stream is prevented by a blower in advance of the zone of introduction of the raw material.

The blower prevents a large pressure differential at the point of material supply and at the same time accommodates maintenance of a high vacuum and rate of flow of gas for the transporting of the material. The gas conduit leading to the last separator has an elongated riser so that the moist material introduced into the gas stream is maintained in contact with the hot gases for a long period to effect efficient pre-drying of the material.

9 Claims, 1 Drawing Figure

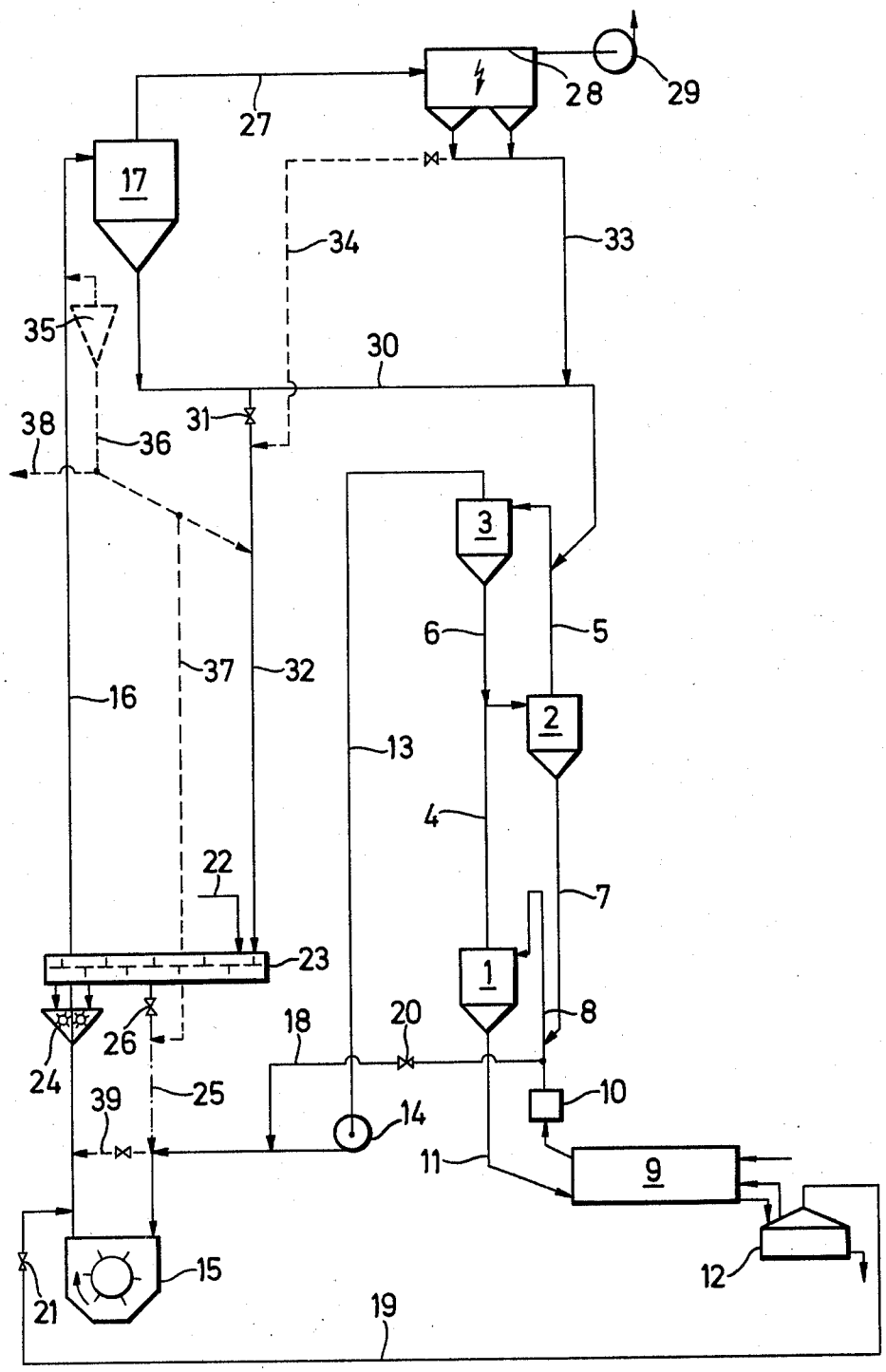
28
29
27
17
34
33
35
30
38
31
36
3
6
5
37
32
16
2
13
4
22
7
23
1
8
18
20
26
24
25
10
39
14
11
9
15
12
21
19

APPARATUS FOR THERMAL TREATMENT OF MOIST RAW MATERIAL

BACKGROUND OF THE INVENTION

This invention relates to the art of heat treating moist pulverulent material such as raw material to be calcined for the preparation of cement and particularly deals with the thermal treatment of slurries of pulverulent raw cement material to minimize introduction of infiltrated air into the heat exchange system while maintaining high vacuum in the system.

It has heretofore been proposed to stop entry of infiltrated air into thermal heat treating devices for slurries and the like by introducing fine granular moist material into a gas conduit of a heat exchange system having two separators by means of a centrifugal roller. Such a device is described in Swiss Pat. No. 394,953 dated Dec. 15, 1965. According to this Swiss patent, the raw material is introduced into the system by a feed worm to a centrifugal roller and thin layers of the material are scraped from the roller and discharged into a stream of drying gas. However, a good distribution of the moist charging material in the stream of gas can only be obtained in this apparatus when the charging material was composed of a sprayable substance. Where the charging material is inclined to agglomerate, the agglomerated particles drop downwardly in the gas stream and interfere with efficient drying.

The present invention eliminates the above indicated disadvantages of the prior art by installing a blower in the gas conduit in advance of the point of materials supply. The blower is regulated relative to the conditions in the gas conduit so that at the point of materials supply, no differential pressure, or only a low differential pressure, prevails thereby preventing infiltration of outside air by simple construction devices. Further, the invention contemplates the use of a very long gas conduit leading to the last separator so that an efficient pre-drying of the material is obtained.

In order to maintain a uniform distribution of the charging material into the stream of gas, the gas conduit rises vertically from the point of introduction of the material up to the last separator. Further, the lower end of the vertical gas conduit receives a comminution device which commimutes coarse particles of the material which might drop downwardly in the gas stream to render them sufficiently fine so that they will be picked up by the gas stream and distributed in the separator.

The comminution device can be a centrifugal mill with a direction of rotation corresponding to the direction of gas flow for assisting the picking up of the comminuted material by the gas stream.

The centrifugal mill is preferably so constructed that the gases of the gas stream may flow therethrough to prevent caking of material in the mill.

There is also provided a combustion chamber receiving gases from a drying kiln which heats these gases and discharges them to the first and last separator and if desired also to a point between the blower and the charging point of the material to intensify the drying effect of the gases and making the system useful with very thin liquid slurries.

Another feature of the invention includes the provision of an air cooler receiving material from the kiln with the exhaust air being used for pre-drying the moist charging material and with particles of dust in this exhaust of the cooler being reintroduced into the system and precipitated thereby eliminating heretofore required cooler-exhaust air-dust-removal.

A further feature of the invention is the superimposing of the separators up to the last separator and providing a gas conduit leading to this last separator which has an elongated downturned leg and an elongated upturned leg with the material to be treated introduced in the lower area of the upturned leg thus providing a reliably operating and space-saving arrangement of separators and conduits.

To remove coarse constituents of the material to be treated from the gas stream before the last separator, the invention also contemplates the installation in the gas conduit between the material charging point and the last separator, a sifter or grader which discharges the coarse material back to the supply line.

Another feature of the invention is a provision of a branch conduit in the material discharge outlet of the last separator so that dry material separated out in this last separator may be mixed with moist charging material to effect a drying of the moist charging material.

Further, the supply of raw material to the system may take place either in the gas conduit leading to a centrifugal mill or to the centrifugal mill itself.

Other and further details, features and advantages of this invention will be apparent to those skilled in this art from the following detailed description of a preferred embodiment of the invention as shown in the attached drawing.

ON THE DRAWING

The single FIGURE of the drawing digrammatically represents a system for the thermal treatment of moist raw material, particularly slurries of pulverulent cement material, incorporating the features of this invention.

AS SHOWN ON THE DRAWING

The system of this invention includes three superimposed gas and solids separators 1, 2 and 3 connected by exhaust gas conduits 4 and 5 and by material conduits 6 and 7. The lowermost separator 1 is connected to a rotary drying kiln 9 on the gas side by a conduit 8 into which discharges the material conduit 7 of the middle separator 2. In this gas conduit 8, there is installed a combustion chamber 10 heating the gases issuing from the rotary kiln 9.

Material from the lower-most separator 1 is supplied through a material conduit 11 to the rotary kiln 9 where it is dried and then discharged to an air cooler 12.

The top separator 3 has an exhaust gas conduit 13 with an elongated downturned vertical leg and an elongated upturned vertical leg or riser feed pipe 16. A blower 14 is mounted in the lower end portion of this exhaust gas conduit 13 together with a centrifugal commutation mill 15 with a gas conduit leading vertically upwardly therefrom to a separator 17. The riser or feed pipe 16 which is part of the exhaust gas conduit 13 provides a vertically elongated path.

The gas conduit 13 also is connected to a branch conduit 18 receiving gas from the gas conduit 8 and discharging into the gas stream from the blower 14 thereby protecting the blower from hot furnace exhaust gases which are introduced into the branch conduit 18.

In addition, an exhaust air conduit 19 connects the cooler 12 with the riser or feed pipe 16. A gas or air quantity regulating valve 20 is installed in the branch conduit 18 and smilar valve 21 is installed in the air conduit 19.

The raw material is introduced at 22 into the system through a worm feed 23 discharging into a charging hopper 24 having feed rollers discharging into the riser or feed pipe 16. A conduit 25 controlled by a shut-off valve 26 leads from the worm 23 to the exhaust gas conduit 13.

A gas discharge conduit 27 from the separator 17 leads to an electrofilter 28 having an exhaust blower 29 discharging to the atmosphere. On the material discharge side of the separator 17, a dry material discharge conduit 30 discharges into the gas conduit 5 connecting the two uppermost separators 2 and 3 and from this conduit 30 a branch conduit 32 provided with a shutoff valve 31 leads to the material charging worm 23. A branch conduit 33 for the dust discharge of the eletrofilter 28 leads to the dry material conduit 30 and an alternate branch conduit shown in the dotted line 34 and equipped with a shutoff valve leads to the dry material conduit 32.

The riser or feed pipe 16, between the worm feed 23 and the separator 17 may be equipped with a sifter or grader 35, shown in dotted lines, which serves to separate coarse constituents from the stream of gas guided upwardly in the riser or feed pipe 16. The coarse material separated by the sifter may be supplied either through a branch conduit 36 into the branch conduit 32 and thence to the feed worm 23, or through conduits 37 and 25 to the mill 15 to be delivered to the riser or feed pipe 16 for post treatment. In the event the coarse material separated in the sifter or grader 35, for any reason, should not be conveyed back to the riser or feed pipe 16, it can be discharged from the system as shown at 38.

OPERATION

The system of this invention receives hot furnace exhaust gases from the rotary kiln 9, which are further heated in the combustion chamber 10, through the conduit 8, bottom separator 1, conduit 4, intermediate separator 2, conduit 5 and top separator 3 and thence through the exhaust gas conduit 16 with the aid of the blower 14 either through the centrifugal mill 15 or through the by-pass 39 shown in dotted lines, to the riser or feed pipe 16. Then the gases are withdrawn to the atmosphere through the separator 17, conduit 27, electrofilter 28 and blower 29 which pulls a vacuum creating an updraft in the riser 16.

The moist raw material or slurry is fed to the system at 22 to the worm gear 23 which acts as a mixer and preferably has two flights of worms. The worm feed 23 discharges to the charging hopper 24 and the material is then introduced with the aid of centrifugal rollers into the hot stream of gas into the riser or feed pipe 16 near the bottom of this feed pipe. The material is suspended in the hot gases in the feed pipe 16 to be dried and discharged into the dust separator effecting a predyring to the extent that some of the material may be separated as dry material. The coarser particles drop downwardly to the centrifugal mill 15 where they are comminuted to such an extent that they may be entrained in the upwardly directed stream of gas and discharged into the separator 17. The dry material from the separator 17 is introduced through the conduit 30 to the exhaust gas conduit 5 connecting both uppermost separators 1 and 2 and then passes through the separators 3, 2 and 1 from top to bottom to be brought into contact with the hot gases flowing from the bottom out of the rotary kiln 9 and combustion chamber 10. The material pre-treated in this manner finally reaches the rotary kiln 9 through the conduit 11 where it is subjected to a thermal post treatment such as sintering. The material treated in the rotary kiln is discharged from the kiln to the cooler 12 and then either discharged from the system or recycled back to the kiln.

When the raw material being treated is a slurry, it is particularly desirable that dry material be mixed with the slurry to effectively support dehydration. The dry material is very suitably removed from the conduit 30 which connects the separator 17 with the exhaust conduit 5 and is mixed through the branch conduit 32 with the charging material in the feed worm 23. The quantity of admixture of drying material may be adjusted with the aid of the throttle valve 31 arranged in the branch conduit 32. Beyond this point the filtered dust from the electrofilter 28 may also be admixed with the charging material through the branch conduits 34 and 32. The remainder of the dust in the electrofilter separated out of the gas stream is fed through the conduit 33 and into the conduit 30 to be there mixed with material pre-dried in the riser 16.

Coarse constituents of the charging material separated out in the sifter or grader 35 can be admixed with the charging material through the conduits 36 and 37 to be fed back to the riser or feed pipe 16. The coarse grains may also be removed from the sifter or grader 35 to be admixed with dust from the separator 17 or electrofilter 28. In case the coarse material separated in the sifter 35 cannot be admixed back with the charging material it can be discharged out of the system through the conduit 38.

Depending upon the moisture content and composition of the raw material to be treated it might be advantageous, according to this invention, to remove hot gases from the conduit 8 connected in series with the combustion changer 10 and introducing the same through the conduit 13 and centrifugal mill 15 or directly through the by-pass 39 to the riser or feed pipe 16. For the regulation of the required quantity of hot gas withdrawn from the conduit 8, the throttle member 20 in the branch pipe 18 is adjusted. The hot gas branch conduit 18 controlled by the valve 20 discharges very advantageously down stream from the blower 14 in the exhaust conduit 13 and in this manner, the blower protects the exhaust conduit 13 from a thermal overload.

A part or the entire exhaust air from the cooler 12 is introduced through the conduit 19 for pre-drying of the charging material in the riser or feed pipe 16 to utilize the heat content of this exhaust air. The throttle valve 21 controls flow through the conduit 19. The system of this invention very advantageously draws off heating and exhaust gases as well as heated air from a cooler for the pre-drying of the charging material which is introduced into the feed pipe 16 by the feed worm 23 either through the charging hopper 24 or through a conduit 25 and the cetrifugal mill 15. The charging of the raw material or the already pre-dried material from the sifter or grader 35 is conveniently handled through the centrifugal mill 15 which comminutes the coarse grain materials.

It will be understood that this invention is not limited to the hereinabove specific description of the drawings and that this description and the illustration in the drawings is intended to show, by way of an example only, a preferred embodiment of the invention.

From the above descriptions, it should be understood to those skilled in this art that pulverulent granular material which may be in the form of a slurry, is kiln treated in a most efficient manner, utilizing hot gases from the kiln, which may be further heated after leaving the kiln to preheat the wet material or slurry as it rises through an elongated vertical feed pipe receiving the gases from a blower which in turn receives the gases from the next-to-the-last separator in the system. The gas side of the kiln, preferably after having the gases further heated in a combustor, discharges into a low-level separator and then receives the material discharged from a superimposed separator. The gases from the low-level separator feed into the superimposed separator and are in turn then fed to a third separator at a still higher level with the material from the third separator being received into the second separator. The gases from the third separator are then fed through the blower to the riser pipe to pre-dry the raw material, and the blower effectively feeds the hot gases to the raw material at the same pressure that exists in the raw material inlet. In this manner, air infiltration into the system is prevented.

We claim as our invention:

1. Apparatus for the thermal treatment of moist pulverulent solid material including slurries of such material which comprises a hot gas source, a pulverulent material source, an elongated riser conduit, a plurality of gas and material separators arranged in series including a last separator, a first separator, and a next-to-the-last separator, means for charging pulverulent material from said source into said riser conduit near the bottom thereof, a comminuter in said riser conduit at a level below said means for charging pulverulent material constructed and arranged to reduce coarse pulverulent material falling in the riser and reintroduce the reduced material back into the riser, conduits conveying hot gas from said hot gas source successively to each separator in said series from the first to the next-to-the-last separator, a conduit discharging gas from the last separator, conduits conveying pulverulent material from the last separator successively through all of the separators to the first separator, a conduit conveying pulverulent material from the first separator to the hot gas source, a conduit conveying gas from the next-to-the-last separator to said riser upstream from the means for charging pulverulent material into the riser, and a blower in said last mentioned conduit increasing the gas flow through the riser for drawing for drawing the pulverulent material from said means for charging pulverulent material and said comminuter.

2. The apparatus of claim 1 including a gas cooler in the conduit discharging gas from said last separator.

3. The apparatus of claim 1 wherein the comminuter is a centrifugal mill rotating in the direction of gas flow therethrough.

4. The apparatus of claim 1 including a seive in the riser conduit separating coarse pulverulent material from the gas stream and means discharging the separated coarse material to said pulverulent material source.

5. The apparatus of claim 1 including a branch conduit in the conduit conveying pulverulent material from the last separator conveying pulverulent material from the last separator to said pulverulent material source.

6. The apparatus of claim 1 including a conduit conveying pulverulent material from said pulverulent material source to said comminuter.

7. Apparatus for kiln drying moist pulverulent material or slurries of such material which comprises a rotary drying kiln having an air inlet, a hot gas outlet, a material inlet and a material outlet, a combustor receiving hot gases from the kiln, a plurality of sequentially connected gas and material separator including a first separator receiving gases from the combustor and discharging material to the kiln, a second separator discharging material into the gas stream feeding the first separator, a gas conduit connecting the first separator with the second separator, a gas conduit connecting the second separator with a third separator, a materials conduit connecting the third separator with the second separator, a last separator, a materials conduit connecting the last separator with third separator, a gas conduit connecting the third separator with the last separator having an elongated downturned leg and an elongated riser, a blower in the lower portion in the downturned leg of said gas conduit, means for introducing raw material to be dried into the riser portion of said conduit connecting the last separator with the third separator, and a commutation mill at a level below said means for introducing raw material receiving coarse material from the riser and gases from the blower discharging back to the riser whereby the blower prevents infiltration of air into the apparatus.

8. The method of heat treating most pulverulent material or slurries of such material which comprises introducing said material into an upwardly flowing hot gas stream, separating the material from the hot gases at the top of said stream, feeding the separated material successively through a series of gas and material separators, feeding the separated material from the last separator of said series to a hot gas source, feeding hot gases from said hot gas source successively through said series of separator in counter-current flow to the direction of flow of the material through the separators, positively blowing hot gases from the top of the last separator of said series of separators into the bottom of said upwardly flowing hot gas stream, controlling said positive blowing of the hot gases to increase the flow of the upwardly flowing hot gas stream sufficiently to draw the pulverulent material into the stream and allow coarse material to drop in the stream, comminuting the dropped coarse material in the stream and reintroducing the comminuted material back into the stream.

9. The method of thermally treating wet raw pulverulent material for cement which comprises feeding the wet material into a rising column of hot gases, blowing the hot gases into the bottom of the column to draw the wet material into the rising stream, controlling the blowing of the hot gases into the column to accommodate falling of coarse pulverulent material in the column, comminuting the coarse material, and reintroducing the comminuted material back into the column.

* * * * *